US006660710B1

(12) United States Patent
Hayashi et al.

(10) Patent No.: US 6,660,710 B1
(45) Date of Patent: Dec. 9, 2003

(54) SOFTENER COMPOSITION

(75) Inventors: Hiromitsu Hayashi, Wakayama (JP); Noriko Yamaguchi, Wakayama (JP); Ikuo Sugano, Wakayama (JP); Shuji Tagata, Wakayama (JP)

(73) Assignee: Kao Corporation, Tokyo (JP)

( * ) Notice: Subject to any disclaimer, the term of this patent is extended or adjusted under 35 U.S.C. 154(b) by 238 days.

(21) Appl. No.: 09/889,153

(22) PCT Filed: Nov. 9, 2000

(86) PCT No.: PCT/JP00/07896

§ 371 (c)(1),
(2), (4) Date: Nov. 27, 2001

(87) PCT Pub. No.: WO01/36736

PCT Pub. Date: May 25, 2001

(30) Foreign Application Priority Data

| | | |
|---|---|---|
| Nov. 12, 1999 | (JP) | 11-323164 |
| Apr. 4, 2000 | (JP) | 2000-102427 |
| Apr. 14, 2000 | (JP) | 2000-114095 |

(51) Int. Cl.[7] ..... C11D 1/825
(52) U.S. Cl. ..... 510/499; 510/501; 510/515
(58) Field of Search ..... 510/499, 501, 510/504, 515

(56) References Cited

U.S. PATENT DOCUMENTS 5,861,371 A * 1/1999 Wilsch-Irrgang et al. ... 510/504

FOREIGN PATENT DOCUMENTS

| | | |
|---|---|---|
| EP | 0 398 137 | 11/1990 |
| EP | 0 472 178 | 2/1992 |
| JP | 7-3649 | 1/1995 |
| JP | 7-65267 | 7/1995 |
| JP | 10 512015 | 11/1998 |
| WO | WO 93/05139 | 3/1993 |
| WO | WO 98/56886 | 12/1998 |

* cited by examiner

*Primary Examiner*—John Hardee
(74) *Attorney, Agent, or Firm*—Oblon, Spivak, McClelland, Maier & Neustadt, P.C.

(57) ABSTRACT

A softener composition which suppresses body smell comprising (a) 3 to 50 percent by weight of a tertiary amine and/or a salt thereof, having an ester and/or an amide and at least one alkyl or alkenyl having 10 to 22 carbon atoms and at least one of the compound represented by the formula (1), formula (2), or formula (3), (1)

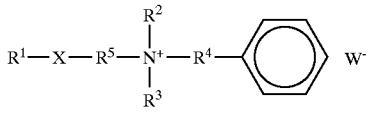

(2)

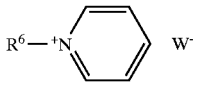

(3)

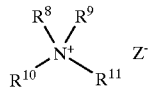

wherein $R^1$ and $R^6$ are a $C_{5-12}$ alkyl or alkenyl group, $R^2$ and $R^3$ are a $C_{1-3}$ alkyl or hydroxyalkyl group and X is —COO—, —OCO—, —CONH—, —NHCO—, 1,4-phenyl, or a linkage, $R^4$ represents a $C_{1-3}$ alkylene group, $R^5$ represents a $C_{1-6}$ alkylene group or $—(O—R^7)_n—$, $R^7$ is ethylene group or propylene group and n is a number of 1 to 10; and $W^-$ is an anionic group; two or three of $R^8$, $R^9$, $R^{10}$ and $R^{11}$ are a $C_{8-12}$ alkyl, the remainder of them are a $C_{1-3}$ alkyl, a $C_{1-3}$ hydroxyalkyl or a $C_{7-15}$ arylalkyl and $Z^-$ is an anionic group.

24 Claims, No Drawings

SOFTENER COMPOSITION

This application claims priority from Japanese Applications JP 11-323,164, filed Nov. 12, 1999, JP 2000-102427, filed Apr. 4, 2000; and JP 2000-114,095, filed Apr. 14, 2000.

TECHNICAL FIELD

The present invention relates to a softener composition.

BACKGROUND ART

Heretofore, quaternary ammonium salts having long-chain alkyl group, acid salts of tertiary amines, etc. have been used for softeners. Further, compounding of a softener composition with an antimicrobial agent has been attempted for sanitation and deodorization of fiber products. JP-A 10-512015 discloses a softener composition comprising a water-insoluble quaternary ammonium salt as a softener and a water-soluble quaternary ammonium salt as an antimicrobial agent compounded therein. In addition, JP-A 7-3649 discloses a fiber product-softener composition, having pH 2 to 5, comprising a di-long-chain-alkyl amine ($C_{6-24}$ alkyl or alkenyl group which may be interrupted by an ether linkage, ester linkage or acid amide linkage) and a mono-long-chain-alkyl quaternary ammonium salt ($C_{6-24}$ alkyl or alkenyl group which may be interrupted by an ether linkage, ester linkage or acid amide linkage), at a weight ratio of from 9:1 to 5:5. WO 98/56886 discloses an antimicrobial fiber softener composition, being suitable for conferring antimicrobial performance on fibers, comprising a conventional fiber softener composition and one or more cationic antimicrobial agents in a larger amount than required for antimicrobial performance.

It, however, is a problem that such a composition is provided with only a small effect to suppress a nasty smell of clothes washed and dried in a room and a body smell derived from sweat at the time of wearing. Especially it has a low effect to chemical fiber clothes. It does not meet any of storage stability or a softening effect and the above mentioned smell-suppressing effect. Especially the softening effect is not sufficient to chemical fiber clothes.

DISCLOSURE OF INVENTION

Accordingly, the purpose of the present invention is to provide a softener composition which suppresses a body smell etc. of clothes, derived from sweat, and is excellent in the storage stability and the softening effect.

The present invention relates to a softener composition comprising:

(a) 3 to 50 percent by weight of a tertiary amine and/or a salt thereof, having an ester and/or an amide and at least one alkyl or alkenyl having 10 to 22 carbon atoms and (b) the below shown component and/or (c) the below shown component.

(b) 0.1 to 15 percent by weight of the compound represented by the formula (1) and/or the compound represented by the formula (2):

(1)

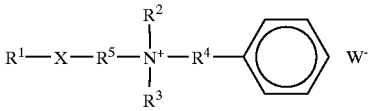

-continued (2)

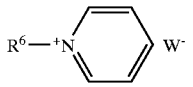

wherein $R^1$ and $R^6$ independently represent a $C_{5-9}$ alkyl or alkenyl group, $R^2$ and $R^3$ independently represent a $C_{1-3}$ alkyl or hydroxyalkyl group and X is —COO—, —OCO—, —CONH—, —NHCO—,

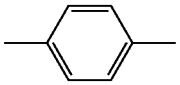

or a linkage, $R^4$ represents a $C_{1-3}$ alkylene group, $R^5$ represents a $C_{1-6}$ alkylene group or $—(O—R^7)_n—$, $R^7$ is ethylene group or propylene group and n is a number of 1 to 10; and $W^-$ is an anionic group;

(c) 0.01 to 15% by weight of a compound represented by formula (3):

(3)

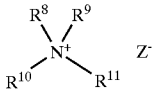

wherein two or three of $R^8$, $R^9$, $R^{10}$ and $R^{11}$ are a $C_{8-12}$ alkyl, the remainders of them are a $C_{1-3}$ alkyl, a $C_{1-3}$ hydroxyalkyl or an arylalkyl having 7 to 15 of the total carbon number and $Z^-$ is an anionic group. The linkage means a conjugate bond by which $R^1$ and $R^5$ are directly connected with each other.

Embodiments of Worked Invention (a) Component:

The component (a) of the invention is a tertiary amine and/or a salt thereof, having in the molecule thereof an ester and/or an amide and at least one alkyl or alkenyl having 10 to 22 carbon atoms. In particular the compound having the formula (4) and a salt of the compound having the formula (4) with an acid agent are preferable from the feeling in touch of clothes.

(4)

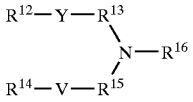

wherein $R^{12}$ and $R^{14}$ independently represent an alkyl or alkenyl group having 10 to 22 of carbon atoms, preferably 12 to 18, Y and V are independently —COO—, —CONR$^{17}$—, —OCO—or —NR$^{17}$CO—, preferably at least one of them being —COO— or —OCO—. $R^{17}$ represents a hydrogen atom or a $C_{1-3}$ alkyl or hydroxyalkyl group, preferably hydrogen atom. $R^{13}$ and $R^{15}$ independently represent a $C_{1-5}$ alkylene group, $R^{16}$ represents a $C_{1-3}$ alkyl or hydroxyalkyl group or $R^{12}$—Y—$R^{13}$—.

The acid for the salt is preferably hydrochloric acid, sulfuric acid, phosphoric acid, a $C_{1-12}$ fatty acid or a $C_{1-3}$ alkylsulfuric acid.

In the compound having the formula (4), the following compound and a salt thereof are especially preferable. The salt is preferably a salt with hydrochloric acid, sulfuric acid or phosphoric acid.

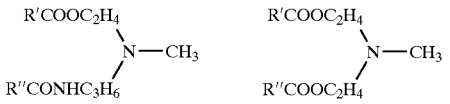

in which R' and R" are the same as or different from each other and a $C_{12-18}$ alkyl or alkenyl.

In the invention, a compound having the formula (5) may be preferably added to the compound (4) from the viewpoint of feeling in touch of clothes.

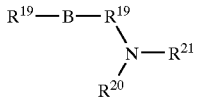

(5)

in which $R^{18}$ represents a $C_{12-22}$, preferably $C_{14-18}$, more preferably $C_{12-18}$, alkyl or alkenyl group, B is —COO—, —CONR$^{22}$—, —OCO— or —NR$^{22}$CO—, preferably —COO— or —CONR$^{22}$—, $R^{22}$ represents a hydrogen atom or a $C_{1-3}$ alkyl or hydroxyalkyl group, preferably a hydrogen atom; $R^{19}$ represents a $C_{1-5}$ alkylene group, $R^{20}$ represents a $C_{1-3}$ alkyl or hydroxyalkyl group or —$R^{25}$—OH, $R^{25}$ is a $C_{1-5}$ alkylene group and $R^{21}$ represents a $C_{1-3}$ alkyl or hydroxyalkyl group or $R^{21}$ may represent $R^{18}$—B—$R^{19}$.

The compound (5) may be in the form of a salt thereof, preferably being used in the form of an acid salt neutralized with an inorganic or organic acid from the viewpoint of the softening effect. The acid is preferably at least one selected from sulfuric acid, hydrochloric acid, phosphoric acid, a $C_{1-12}$ fatty acid and a $C_{1-3}$ alkylsulfuric acid. The neutralization may be effected in advance to incorporation of the compound (5) into the composition. It may be effected after incorporation of the compound (5).

The softener of the invention including the component (b) may preferably contain the compound (4) and the compound (5) at the weight ratio of (4) to (5) in the range of from 70:30 to 99:1, especially from 80:20 to 95:5 from the viewpoint of the softening effect. Alternatively the softener of the invention including the component (c) may preferably contain the compound (5) and the compound (4) at the weight ratio of (5) to (4) in the range of from 1/1 to 1/50, more preferably from 1/2 to 1/30, much more preferably from 1/3 to 1/20 from the viewpoint of the softening effect.

(b) Component

The softening composition of the invention includes the above shown compounds (1) and/or compounds (2) as the component (b). The most preferable component (b) is the following compound in which $W^-$ is above defined.

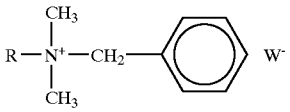

in which R is a $C_{12-16}$ alkyl.

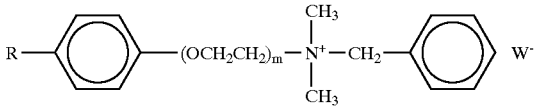

in which R is a $C_{6-10}$ alkyl and m is a number of 1 to 5.

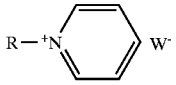

in which R is a $C_{8-18}$ alkyl.

(c) Component

The invention includes the above shown compound (3) as the component (c). In the formula (3) the anionic ion shown by $Z^-$ is preferably sulfuric ion, a halogen ion, a $C_{1-12}$ fatty acid ion or a $C_{1-3}$ alkylsulfuric acid ion.

(Softener Composition)

The softener composition of the invention comprises 3 to 50 percent by weight, preferably 3 to 40 percent by weight, especially preferably 5 to 35 percent by weight, of the component (a). It further comprises either the above shown component (b) or (c).

The component (b) may be contained in an amount of 0.1 to 15 percent by weight, preferably 1 to 15 percent by weight, especially preferably 1 to 10 percent by weight. The weight ratio of (b)/(a) is preferably 1/30 to 1/1, more preferably 1/10 to 1/1 from the viewpoint of storage stability, the feeling in touch of clothes and offensive smell-suppressing effect to chemical fiber.

The component (c) may be contained in an amount of 0.01 to 15 percent by weight, preferably 0.1 to 10 percent by weight. The weight ratio of (c)/(a) is preferably 1/50 to 1/1, more preferably 1/30 to 1/2, much more preferably 1/20 to 1/2 from the viewpoint of storage stability, the feeling in touch of clothes and offensive smell-suppressing effect to chemical fiber.

The softener composition of the present invention is preferably in the form of an aqueous solution comprising at least the component (a) and the component (b) and/or the component (c), diluted in water. The water used is preferably distilled water or deionized water. It is desirable for storage stability that water is incorporated in an amount of 40 to 90% by weight, more preferably 50 to 85% by weight and particularly preferably 60 to 85% by weight into the composition.

Further, it is preferable to the smell-suppressing effect and for storage stability that the composition of the present invention is adjusted to a pH value of 2 to 5, and particularly 2.5 to 4 at 20° C.

In the present invention, a nonionic surfactant and/or an anionic surfactant (d) may be preferably incorporated in addition to the above components (a) and (b) or (c) for storage stability. The nonionic surfactant is preferably a polyoxyethylene alkyl ether containing a $C_{8-20}$ alkyl or alkenyl group, particularly preferably a nonionic surfactant of the formula (6):

$$R^{23}—T—[(R^{24}O)_p—H]_q \quad (6)$$

wherein $R^{23}$ is a $C_{10-18}$, preferably $C_{12-18}$, alkyl or alkenyl group, $R^{24}$ is a $C_2$ or $C_3$ alkylene group, preferably ethylene group; p is a number of 2 to 100, preferably 5 to 80, more preferably 10 to 80 and particularly preferably 20 to 60; and T is —O—, —CON— or —N— and when T is —O—, q is 1, and when T is —CON— or —N—, q is 2.

The compound of the formula (6) includes for example the following compounds:

$$R^{23}—O—(C_2H_4O)r\text{-}H$$

wherein $R^{23}$ has the same meanings as defined above; and when the component (b) is contained, r is a number of 8 to 100, preferably 20 to 60, and when the component (c) is contained, r is a number of 5 to 100, preferably 10 to 80.

$$R^{13}—O—(C_2H_4O)s(C_3H_6O)t\text{-}H$$

wherein $R^{23}$ has the same meanings as defined above; s and t are independently a number of 2 to 40, preferably 5 to 40, and the sum in total of s and t is preferably an integer of 10 to 80, and ethylene oxide units and propylene oxide units may be a random- or block-addition product.

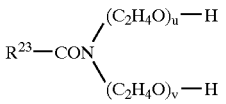

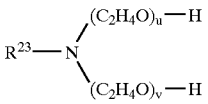

wherein $R^{23}$ has the same meanings as defined above; and when the component (b) is contained, the sum in total of u and v is a number of 5 to 100, preferably 5 to 80, and when the component (c) is contained, the sum in total thereof is a number of 10 to 100.

From the viewpoint of stability the amount of the nonionic surfactant incorporated is 0.5 to 10% by weight, preferably 1 to 8% by weight.

For the purpose of improving the feeling in touch of fiber products in the present invention, it is preferable to incorporate an anionic surfactant, especially a fatty acid or a salt thereof. For example are included caprylic acid, capric acid, lauric acid, myristic acid, palmitic acid, stearic acid, oleic acid and a mixture thereof. In particular are preferable at least one selected from lauric acid, stearic acid and oleic acid. Further, fatty acids having an alkyl composition derived from coconut oil, palm oil, palm kernel oil or tallow are also preferable. They may be used in the form of a salt thereof preferably with sodium, potassium, magnesium or calcium. The sodium salt is more preferable. The amount of the above shown anionic surfactant is preferably 0.01 to 5 percent by weight, especially 0.5 to 3 percent by weight.

In the present invention, it is preferable for storage stability that an ester compound of a $C_{8-22}$ saturated or unsaturated fatty acid and a polyhydric alcohol is incorporated in an amount of 0.1 to 10% by weight, particularly 0.5 to 5% by weight into the composition. The ester compound is preferably triglycerides, diglycerides, monoglycerides, a mono-, di- or tri-ester of pentaerythritol and sorbitan ester.

In the present invention, it is desirable for storage stability that inorganic salts such as calcium chloride are added in an amount of 0 to 1000 ppm, preferably 1 to 1000 ppm, and more preferably 10 to 500 ppm. Sodium salts and potassium salts are contained in surfactants such as fatty acid salts and the inorganic salts mixed in the composition by using such surfactants are not subject to the above limitation.

In the present invention, a solvent component selected from ethanol, isopropanol, glycerin, ethylene glycol, propylene glycol, diethylene glycol, dipropylene glycol and polyoxyethylene phenyl ether is further preferably incorporated for storage stability. These solvent components are incorporated in an amount of preferably 0 to 20% by weight, more preferably 0.1 to 20% by weight and particularly preferably 0.5 to 10% by weight into the composition. If ethanol is used, it is desirable to use a polyoxyethylene alkyl ether sulfate-modified ethanol or an 8-acetylated sucrose-modified ethanol.

Ingredients such as silicone which is ordinarily incorporated into a fiber-treating agent, a perfume (particularly preferably a combination of aroma components shown as the components (c) and (d) described in JP-A 8-11387) and a coloring matter may be incorporated into the softener composition of the present invention.

The softener composition of the invention is provided with the suppressing effect of smell attached to clothes such as a body smell derived from sweat, especially in chemical fiber clothes.

EXAMPLES

Compounding Ingredients

The ingredients used in the present invention are shown below.

(a-1)

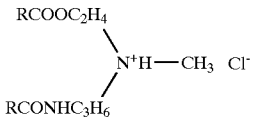

R: a mixed $C_{18}$ and $C_{16}$ saturated alkyl group (ratio by weight of $C_{18}$ group/$C_{16}$ group=60/40)

(a-2)

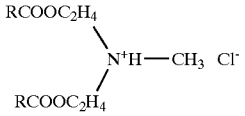

R: a mixed $C_{18}$ and $C_{16}$ saturated alkyl group (ratio by weight of $C_{18}$ group/$C_{16}$ group 60/40)

(a-3)

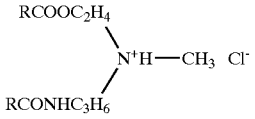

R: a mixed $C_{17}$ and $C_{15}$ saturated alkyl group (ratio by weight of $C_{17}$ group/$C_{15}$ group=60/40)

(a-4)

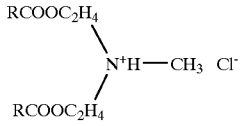

R: a mixed $C_{17}$ and $C_{15}$ saturated alkyl group (ratio by weight of $C_{17}$ group/$C_{15}$ group=60/40)

(a-5)

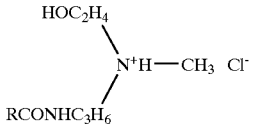

R: a mixed $C_{17}$ and $C_{15}$ saturated alkyl group (ratio by weight of $C_{17}$ group/$C_{15}$ group=60/40)

(a-6)

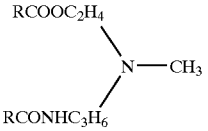

R: a mixed $C_{17}$ and $C_{15}$ saturated alkyl group (ratio by weight of $C_{17}$ group/$C_{15}$ group=60/40)

(a-7)

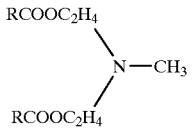

R: a mixed $C_{17}$ and $C_{15}$ saturated alkyl group (ratio by weight of $C_{17}$ group/$C_{15}$ group=60/40)

(a-8)

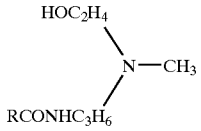

R: a mixed $C_{17}$ and $C_{15}$ saturated alkyl group (ratio by weight of $C_{17}$ group/$C_{15}$ group=60/40)

(a'-1) Di(oleoyl oxyethyl) dimethyl ammonium methyl sulfate (a"-1) dioleyldimethylammonium chloride (b-1)

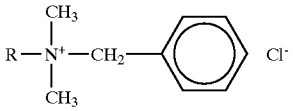

R: a alkyl composition derived from coco oil (b-2)

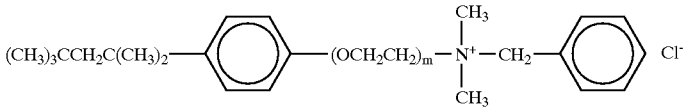

(b-3)

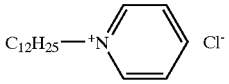

(c-1) Didecyl-dimethylammonium chloride.

(d-1) An addition product of a saturated alcohol containing 12 carbon atoms to which 21 moles on the average of ethylene oxide have been added.

(d-2) An addition product of lauric acid diethanolamide to which 20 moles on the average of ethylene oxide have been added.

(d-3) Lunack™ S-50 (stearic acid produced by Kao Corporation)

(e-1) Excel™ 150 [a mixture of stearic mono-, di- and tri-glycerides (mono:di:tri=60:35:5) produced by Kao Corporation].

(e-2) calcium chloride (e-3) ethylene glycol (f-1) Coloring matter (Acid blue 9).

(f-2) Perfume [a mixture of hexyl cinnamic aldehyde (18), nerolin yarayara (4), tricyclodecenyl acetate (4), benzyl acetate (10), musk ketone (5), anisyl acetone (2), Sandalmysore core (2), aldehyde C14 peach (1), linalool (18), Dihydromyrcenol (8), borneol (4), cedrol (4), Muguol (5), benzyl alcohol (5) and dipropylene glycol (10), the figures shown in the parentheses meaning a percent by weight in the perfume mixture.].

(f-3) Silicone (TSA730 produced by Toshiba Silicone Co., Ltd.)

Example 1

Using the above compounds, the softener compositions shown in Table 1 were prepared (invention products 1 to 7 and comparative products 1 to 3). Five blouses (60% of acryl, 205 of polyester and 20% of nylon) were washed with a commercial weakly alkaline detergent (Attack™ of Kao Corporation) in a laundering machine (two-tank system laundering machine VH-360S1 manufactured by Toshiba Corp.; detergent concentration of 0.0667% by weight; 30 L tap water used; water temperature of 20° C.; 10 minutes). Thereafter, the washing water was discharged and the clothes were dehydrated for 1 minute. After 30 L tap water was poured into the tank, the clothes were rinsed for 5 minutes, the water was discharged, and the clothes were dehydrated for 1 minute. Then, 30 L tap water was again poured into the tank and 7 ml g of each softener composition of Table 1 was added thereto. It was stirred for 5 minutes. Thereafter, the clothes were dehydrated and dried in air.

(Evaluation of Smell)

Five women aged twenties had worn the above treated clothes for 12 hours. The smell of the worn clothes were judged by a panel of 10 male persons, aged thirties, using the following criteria to determine a mean value.

0: Hardly smelled.

1: Slightly smelled but not annoying.

2: Smelled.

3: Significantly smelled.

(Evaluation of Softening Performance)

The above treated blouses and then blouses (control) of the same material and kind as them, treated in the same way as them except for using no composition of Table 1 were evaluated by a panel of 10 male persons, aged thirties, using the following criteria to determine the mean value. ○ was assigned to the mean value of not less than 2, □ to the mean value of 1 to less than 1.5, Δ to the mean value of 0.5 to less than 1, and X to the mean value of less than 0.5.

+3: much softer than the control

+2: softer than the control

+1: a little softer than the control

0: as soft as the control (Evaluation of Storage Stability)

100 ml of each softener composition of Table 1 were put in a large-mouthed standard bottle (PS No. 11) and placed in a thermostat set in the programmed cycle of −20° C./12 hours 20° C./12 hours. It was allowed to stand there for 1 week. The appearance of the stored liquid was observed using the following criteria.

○ . . . no change in the appearance

X . . . changes observed in appearance such s gelation, separation and precipitates

TABLE 1

| | Product of the present Invention | | | | | | | Comparative Product | | |
|---|---|---|---|---|---|---|---|---|---|---|
| | 1 | 2 | 3 | 4 | 5 | 6 | 7 | 1 | 2 | 3 |
| Softner composition Component (wt %) | | | | | | | | | | |
| (a-1) | 15 | | 6 | | | | | | | |
| (a-2) | | 15 | | | | | | | | |
| (a-3) | | | | 15 | | 6 | 15 | | | |
| (a-4) | | | | | 15 | | | | | |
| (a-5) | | | | | | | 3 | | | |
| (a'-1) | | | | | | | | 15 | 15 | 15 |
| (b-1) | 3 | | | 3 | | | 3 | 3 | | |
| (b-2) | | 3 | | | 3 | | | | | |
| (b-3) | | | 3 | | | 3 | | | | |
| (c-1) | | | | | | | | | 3 | 10 |
| (d-1) | 2 | | 2 | 2 | | 2 | 2 | 2 | 2 | 2 |
| (d-2) | | 2 | | | 2 | | | | | |
| (d-3) | 1 | 1 | 1 | 1 | 1 | 1 | 1 | 1 | 1 | 1 |
| (e-1) | 1 | 1 | 1 | 1 | 1 | 1 | 1 | 1 | 1 | 1 |
| (e-2) | 100 ppm | 100 ppm | 100 ppm | 100 ppm | 100 ppm | 100 ppm | 100 ppm | 100 ppm | 100 ppm | 100 ppm |
| (e-3) | 3 | 3 | 3 | 3 | 3 | 3 | 3 | 3 | 3 | |
| (f-1) | 10 ppm | 10 ppm | 10 ppm | 10 ppm | 10 ppm | 10 ppm | 10 ppm | 10 ppm | 10 ppm | 10 ppm |
| (f-2) | 0.3 | 0.3 | 0.3 | 0.3 | 0.3 | 0.3 | 0.3 | 0.3 | 0.3 | 0.3 |
| (f-3) | 0.1 | 0.1 | 0.1 | 0.1 | 0.1 | 0.1 | 0.1 | 0.1 | 0.1 | |
| deionized water | balance | ← | ← | ← | ← | ← | ← | ← | ← | ← |
| Total | 100 | 100 | 100 | 100 | 100 | 100 | 100 | 100 | 100 | 100 |
| pH (20° C.) | 2.5 | 3 | 3.5 | 2.5 | 3 | 3.5 | 2.5 | 2.5 | 2.5 | 1 |
| Smell | 0.9 | 0.7 | 0.9 | 0.9 | 0.77 | 0.9 | 0.8 | 1.4 | 1.7 | 1.7 |
| Storage Stability | ○ | ○ | ○ | ○ | ○ | ○ | ○ | X | X | X |
| Softening Effect | ○ | ○ | ○ | ○ | ○ | ○ | ○ | □ | □ | Δ |

Example 2

The softener compositions (invention products 8 to 12) shown in Table 2 were prepared in the same manner as in Example 1. The used perfume was a mixture of 100 parts by weight of a composition of Table 3 and 10 parts by weight of dipropylene glycol. These softener compositions were evaluated in the same manner as in Example 1. They were all recognized to exhibit an excellent smell-preventing effect and the storage stability.

TABLE 2

| | Product of the present Invention | | | | |
|---|---|---|---|---|---|
| | 8 | 9 | 10 | 11 | 12 |
| Softener Composition Component (wt %) | | | | | |
| (a-1) | 15 | 15 | | 15 | |
| (a-2) | | | 15 | | 15 |
| (b-1) | 3 | 3 | | 3 | |
| (b-2) | | | 3 | | 3 |
| (d-1) | 2 | 2 | | 2 | |
| (d-2) | | | 2 | | 2 |
| (d-3) | 1 | 1 | 1 | 1 | 1 |
| (e-1) | 1 | 1 | 1 | 1 | 1 |
| (e-2) | 100 ppm | 100 ppm | 100 ppm | 100 ppm | 100 ppm |
| (f-1) | 10 ppm | 10 ppm | 10 ppm | 10 ppm | 10 ppm |
| Perfume | Perfume 1 | Perfume 2 | Perfume 3 | Perfume 4 | Perfume 5 |
| (shown in Table 3) | 0.37 | 0.25 | 0.3 | 0.3 | 0.3 |
| deionized water | balance | ← | ← | ← | ← |
| Total | 100 | 100 | 100 | 100 | 100 |
| pH | 3.5 | 3.5 | 3.5 | 3.5 | 3.5 |

*The pH was adjusted with 0.1 N aqueous sulfuric acid solution or 0.1 N sodium hydroxide solution.

TABLE 3

| Perfume Ingredient (wt %) | Perfume 1 | Perfume 2 | Perfume 3 | Perfume 4 | Perfume 5 |
|---|---|---|---|---|---|
| hexyl cinnamic aldehyde | 0 | 0 | 13 | 0 | 0 |
| nerolin yarayara | 0 | 0 | 3 | 0 | 0 |
| tricyclodecenyl acetate | 0 | 0 | 3 | 0 | 0 |
| benzyl acetate | 0 | 0 | 7 | 0 | 0 |
| musk ketone | 0 | 0 | 3 | 0 | 0 |
| anisyl acetone | 0 | 0 | 1 | 0 | 0 |
| Sandalmysore core | 0 | 0 | 1 | 0 | 0 |
| aldehyde C14 peach | 0 | 0 | 1 | 0 | 0 |
| Methyl ionone-γ | 7 | 0 | 0 | 3 | 0 |
| Iso E Super | 7 | 0 | 0 | 3 | 0 |
| Tentarome | 14 | 0 | 0 | 7 | 0 |
| 4-t-butylcyclohexyl-acetate | 14 | 0 | 0 | 7 | 0 |
| Lilial | 20 | 0 | 0 | 10 | 0 |
| Herional | 3 | 0 | 0 | 2 | 0 |
| Coumarin | 3 | 0 | 0 | 1 | 0 |
| Ambroxan | 1 | 0 | 0 | 0 | 0 |
| alpha-Terpinyl acetate | 0 | 12 | 0 | 0 | 20 |
| Cedryl acetate | 0 | 8 | 0 | 0 | 13 |
| Lyral | 0 | 8 | 0 | 0 | 13 |
| Pearlide | 0 | 4 | 0 | 0 | 7 |
| Sandal synth | 0 | 4 | 0 | 0 | 7 |
| phenylacetoaldehyde 50% PEA | 0 | 0 | 0 | 0 | 1 |
| aldehyde C12MNA | 0 | 0 | 0 | 0 | 1 |
| cinnamyl cinnamate | 0 | 2 | 0 | 0 | 3 |
| Benzyl isoeugenol | 0 | 2 | 0 | 0 | 3 |
| linalool | 0 | 0 | 0 | 0 | 13 |
| Dihydromyrcenol | 0 | 0 | 0 | 0 | 7 |
| borneol | 0 | 0 | 0 | 0 | 3 |
| cedrol | 0 | 0 | 0 | 0 | 3 |
| Muguol | 0 | 0 | 0 | 0 | 3 |
| benzyl alcohol | 0 | 0 | 0 | 0 | 3 |
| phenylethyl alcohol | 12 | 0 | 29 | 0 | 0 |
| citronellol | 6 | 0 | 13 | 0 | 0 |
| terpineol | 6 | 0 | 13 | 0 | 0 |
| phenylethyldimethyl carbinol | 3 | 0 | 7 | 0 | 0 |
| Styrallyl alcohol | 2 | 0 | 3 | 0 | 0 |
| cinnamic alcohol | 2 | 0 | 3 | 0 | 0 |
| 1-Menthol | 0 | 24 | 0 | 27 | 0 |
| geraniol | 0 | 12 | 0 | 13 | 0 |
| Dihydromyrcenol | 0 | 12 | 0 | 13 | 0 |
| Phenyl hexanol | 0 | 6 | 0 | 7 | 0 |
| dimethylbenzyl carbinol | 0 | 6 | 0 | 7 | 0 |
| Total (wt %) | 100 | 100 | 100 | 100 | 100 |

Example 3

Using the above compounds, the softener compositions shown in Table 4 were prepared. Five shirts (100% polyester) weighing 1.5 kg, were washed with a commercial weakly alkaline detergent (Attack™ of Kao Corporation) in a laundry machine (two-tank system laundering machine VH-360S1 manufactured by Toshiba Corp.; detergent concentration of 0.0667% by weight; 30 L of tap water used; water temperature of 20° C.; 10 minutes). Thereafter, the washing water was discharged and the clothes were dehydrated for 1 minute. After 30 L tap water was poured into the tank, the clothes were rinsed for 5 minutes, the water was discharged and the clothes were dehydrated for 1 minute. Then, 30 L of tap water was again poured into the tank and 7 ml of each composition of Table 1 was added thereto. It was stirred for 5 minutes. Thereafter the clothes were dehydrated and air-dried.

(Evaluation of Deodorizing Effect)

The clothes treated as above were worn for 12 hours by 5 males aged twenties and then the smell generated from the worn shirts were judged by a panel of 10 male persons, aged thirties, using the following criteria to determine the mean value. ○ was assigned to the mean value of less than 1, Δ to the mean value of 1 to less than 1.5, and X to the mean value of 1.5 or more. Results are shown in Table 1.

0: Hardly smelled.

1: Slightly smelled but not annoying.

2: Smelled.

3: Significantly smelled.

(Evaluation of Softness)

The above treated blouses and then blouses (control) of the same material and kind as them, treated in the same way as them except for using no composition of Table 4, were evaluated by a panel of 10 male persons, aged thirties, using the following criteria to determine the mean value. ○ was assigned to the mean value of not less than 2, □ to the mean value of 1 to less than 1.5, Δ to the mean value of 0.5 to less than 1 and X to the mean value of less than 0.5. Results are shown in Table 1.

+3: much softer than the control.

+2: Softer than the control.

+1: Slightly softer than the control.

0: Equal to the control.

TABLE 4

| | Product of the present Invention | | | Comparative Product | | |
|---|---|---|---|---|---|---|
| Component (wt %) | 13 | 14 | 15 | 4 | 5 | 6 |
| Softener Composition | | | | | | |
| (a-6) | 12 | | 12 | | | |
| (a-7) | | 12 | | | | |
| (a-8) | 2 | 2 | | | | 2 |
| (a'-1) | | | | 7.5 | 12 | 12 |
| (c-1) | 2 | 1 | 2 | 10 | 2 | 2 |
| (d-1) | 5 | | 5 | 5 | 5 | 5 |
| (d-2) | | 5 | | | | |
| (d-3) | 1 | 1 | 1 | 1 | 1 | 1 |
| (e-2) | 100 ppm | 100 ppm | 100 ppm | 100 ppm | 100 ppm | 100 ppm |
| (f-1) | 10 ppm | 10 ppm | 10 ppm | 10 ppm | 10 ppm | 10 ppm |
| (f-2) | 0.3 | 0.3 | 0.3 | 0.3 | 0.3 | 0.3 |

TABLE 4-continued

| | Product of the present Invention | | | Comparative Product | | |
|---|---|---|---|---|---|---|
| Component (wt %) | 13 | 14 | 15 | 4 | 5 | 6 |
| pH adjusting agent and deionized water | balance | ← | ← | ← | ← | ← |
| pH* | 2.5 | 2.5 | 2.5 | 1 | 2.5 | 2.5 |
| Total | | | 100 wt % | | | |
| Evaluation of Smell | 603 | ○ | ○ | Δ | Δ | Δ |
| Softening Effect | ○ | ○ | □ | X | Δ | □ |

*The pH was adjusted with 0.1 N aqueous sulfuric acid solution or 0.1 N sodium hydroxide solution.

What is claimed is:

1. A softener composition comprising (a) 3 to 50 percent by weight of a tertiary amine and/or a salt thereof, having an ester and/or an amide and at least one alkyl or alkenyl having 10 to 22 carbon atoms, and at least one of 0.1 to 15 percent by weight of the compound represented by the formula (1),

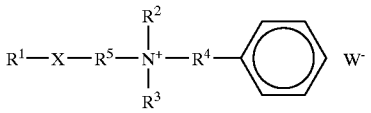

(1)

wherein $R^1$ represents a $C_{5-12}$ alkyl or alkenyl group, $R^2$ and $R^3$ independently represent a $C_{1-3}$ alkyl or hydroxyalkyl group and X is —COO—, —OCO—, —CONH, —NHCO—,

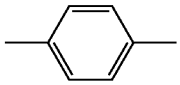

or a linkage, $R^4$ represents a $C_{1-3}$ alkylene group, $R^5$ represents a $C_{1-6}$ alkylene group or $—(O—R^7)_n—$, $R^7$ is ethylene group or propylene group and n is a number of 1 to 10; and $W^-$ is an anionic group;

0.1 to 15 percent by weight of the compound of formula (2):

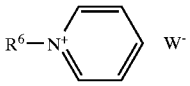

(2)

wherein $R^6$ is a $C_{5-12}$ alkyl or alkenyl group and $W^-$ is an anionic group; or 0.01 to 15% by weight of a compound represented by formula (3):

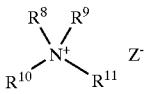

(3)

wherein two or three of $R^8$, $R^9$, $R^{10}$ and $R^{11}$ are a $C_{8-12}$ alkyl, the remainders of them are a $C_{1-3}$ alkyl, a $C_{1-3}$ hydroxyalkyl or an arylalkyl having 7 to 15 carbon atoms and $Z^-$ is an anionic group.

2. The softener composition according to claim 1, which further comprises (d) a nonionic surfactant, an anionic surfactant, or both an anionic and a nonionic surfactant.

3. The composition of claim 2, wherein (d) is a polyoxyethylene alkyl ether containing a $C_{8-20}$ alkyl or alkenyl group.

4. The composition of claim 3, wherein (d) is:

$$R^{23}—T—[(R^{24}O)_p—H]_q \quad (6)$$

wherein $R^{23}$ is a $C_{10-18}$, alkyl or alkenyl group, $R^{24}$ is a $C_2$ or $C_3$ alkylene group, p is a number of 2 to 100, and T is —O—, —CON— or —N— and when T is —O—, q is 1, and when T is —CON— or —N—, q is 2.

5. The composition of claim 2, wherein (d) is present in an amount of from 1–8% by weight.

6. The softener composition of claim 1, wherein (a) is a compound having the formula (4) or a salt thereof

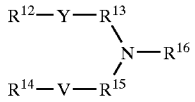

(4)

wherein $R^{12}$ and $R^{14}$ independently represent an alkyl or alkenyl group having 10 to 22 carbon atoms, Y and V are independently —COO—, $—CONR^{17}—$, —OCO—or $—NR^{17}CO—$, $R^{17}$ represents a hydrogen atom or a $C_{1-3}$ alkyl or hydroxyalkyl group, $R^{13}$ and $R^{15}$ independently represent a $C_{1-5}$ alkylene group, $R^{16}$ represents a $C_{1-3}$ alkyl or hydroxyalkyl group or $R^{12}—Y—R^{13}—$.

7. The softener composition of claim 6, wherein compound (4) is a salt of hydrochloric acid, sulfuric acid, phosphoric acid, a $C_{1-12}$ fatty acid or a $C_{1-3}$ alkylsulfuric acid.

8. The composition of claim 6, further comprising a compound of formula (5)

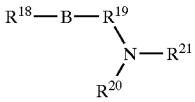

(5)

in which $R^{18}$ represents a $C_{12-22}$alkyl or alkenyl group, B is —COO—, $—CONR^{22}—$, —OCO—or $—NR^{22}CO—$, $R^{22}$ represents a hydrogen atom or a $C_{1-3}$ alkyl or hydroxyalkyl group, $R^{19}$ represents a $C_{1-5}$ alkylene group, $R^{20}$ represents a $C_{1-3}$ alkyl or hydroxyalkyl group or $—R^{25}—OH$, $R^{25}$ is a $C_{1-5}$ alkylene group and $R^{21}$ represents a $C_{1-3}$ alkyl or hydroxyalkyl group or $R^{21}$ may represent $R^{18}—B—R^{29}$.

9. The composition of claim 8, wherein compound (5) is a salt of an acid selected from the group consisting of sulfuric acid, hydrochloric acid, phosphoric acid, a $C_{1-12}$ fatty acid and a $C_{1-3}$ alkylsulfuric acid.

10. The composition of claim 8, comprising a compound of formula (1) or (2) and wherein the weight ratio of (4) to (5) is from 80:20 to 95:5.

11. The softener composition of claim 1, wherein (a) is a compound of formula:

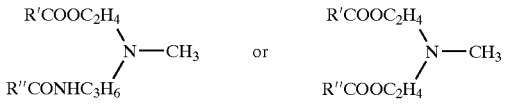

wherein R' and R' are the same as or different from each other and may be a $C_{12-18}$ alkyl, $C_{12-18}$ alkenyl, or a salt thereof.

12. The softener composition of claim 1, comprising a compound of formula (1) having the formula:

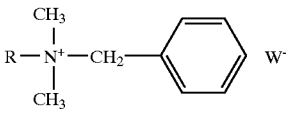

in which R is a $C_{5-12}$ alkyl.

13. The composition of claim 1, comprising a compound having the formula:

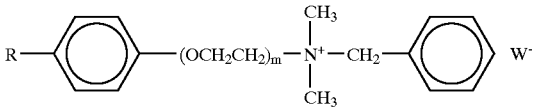

in which R is a $C_{6-10}$ alkyl and m is a number from 1 to 5.

14. The composition of claim 1, comprising a compound of formula (1) having the formula:

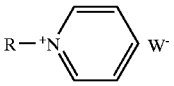

in which R is a $C_{8-12}$ alkyl.

15. The composition of claim 1, comprising a compound of formula (1), formula (2), or both formula (1) and formula (2), in an amount of from 1–10% by weight.

16. The composition of claim 1, wherein a compound of formula (2) is present in an amount of from 0.1–10% by weight.

17. The composition of claim 1, further comprising water in an amount of from 40–90% by weight.

18. The composition of claim 1, further comprising an ester compound of a $C_{8-22}$ saturated or unsaturated fatty acid and a polyhydric alcohol in an amount of from 0.1–10% by weight.

19. The composition of claim 1, further comprising a solvent selected from the group consisting of ethanol, isopropanol, glycerine, ethylene glycol, propylene glycol, diethylene glycol, dipropylene glycol and polyoxyethylene phenyl ether.

20. The composition of claim 1, comprising a compound of formula (1).

21. The composition of claim 1, comprising a compound of formula (2).

22. The composition of claim 1, comprising a compound of formula (3).

23. A method comprising contacting a textile with an aqueous solution comprising the composition of claim 1.

24. The composition of claim 1, wherein two or three of $R^8$, $R^9$, $R^{10}$ and $R^{11}$ are a $C_{8-12}$ alkyl, the remainders of them are a $C_{1-3}$ hydroxyalkyl or an arylalkyl having 7 to 15 carbon atoms.

* * * * *

UNITED STATES PATENT AND TRADEMARK OFFICE

CERTIFICATE OF CORRECTION

PATENT NO. : 6,660,710 B1
DATED : December 9, 2003
INVENTOR(S) : Hayashi et al.

It is certified that error appears in the above-identified patent and that said Letters Patent is hereby corrected as shown below:

Title page,
Item [86], should read:
-- [86] PCT No.: PCT/JP00/07896

§371 (c)(1),
(2), (4) Date: Aug. 27, 2001 --

Signed and Sealed this

Seventeenth Day of February, 2004

JON W. DUDAS
*Acting Director of the United States Patent and Trademark Office*